US007597438B2

(12) United States Patent
Konno et al.

(10) Patent No.: US 7,597,438 B2
(45) Date of Patent: Oct. 6, 2009

(54) IMAGE FORMING APPARATUS AND METHOD

(75) Inventors: Masaaki Konno, Kanagawa (JP); Tetsuzo Kadomatsu, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 380 days.

(21) Appl. No.: 11/230,544

(22) Filed: Sep. 21, 2005

(65) Prior Publication Data

US 2006/0061625 A1 Mar. 23, 2006

(30) Foreign Application Priority Data

Sep. 22, 2004 (JP) ..... 2004-275852

(51) Int. Cl.
*B41J 2/01* (2006.01)

(52) U.S. Cl. ..... 347/102; 347/104; 347/55; 347/101; 347/14

(58) Field of Classification Search ..... 347/102, 347/104, 105, 6, 101, 14, 55
See application file for complete search history.

(56) References Cited

U.S. PATENT DOCUMENTS 5,712,667 A * 1/1998 Sato ..... 347/7
6,508,540 B1 * 1/2003 Lean et al. ..... 347/55
7,152,970 B2 * 12/2006 Hasebe et al. ..... 347/102

FOREIGN PATENT DOCUMENTS

| | | | |
|---|---|---|---|
| JP | 2-169253 A | | 6/1990 |
| JP | 2-212149 A | | 8/1990 |
| JP | 5-4343 A | | 1/1993 |
| JP | 5004343 | * | 1/1993 |
| JP | 05004343 A | * | 1/1993 |

* cited by examiner

*Primary Examiner*—Matthew Luu
*Assistant Examiner*—Henok Legesse
(74) *Attorney, Agent, or Firm*—Birch, Stewart, Kolasch & Birch, LLP

(57) ABSTRACT

The image forming apparatus comprises: an ejection head which ejects ink having electrorheological properties onto a recording medium; an electric field application device which applies an electric field to a droplet of the ink deposited on the recording medium; a fixing promotion device which performs fixing promotion process for promoting fixing of the ink on the recording medium; and a timing control device which controls a time difference between an electric field application cessation timing at which an application of the electric field to the ink on the recording medium by the electric field application device is ceased and a fixing promotion process timing at which the fixing promotion process is performed by the fixing promotion device.

1 Claim, 14 Drawing Sheets

IMAGE FORMING APPARATUS AND METHOD

BACKGROUND OF THE INVENTION

1. Field of the Invention

The present invention relates to an image forming apparatus and method, and more particularly, to image forming technology suitable for an image forming apparatus, such as an inkjet recording apparatus which forms images on a recording medium by ejecting liquid droplets from nozzles.

2. Description of the Related Art

In an inkjet recording head of a recording apparatus, it has been proposed to use an electrorheological fluid in order to prevent bleeding and color mixing of ink, and the like, on the recording medium (see Japanese Patent Application Publication Nos. 2-169253, 2-212149 and 5-4343).

Japanese Patent Application Publication No. 2-169253 discloses an image forming material which is an electrorheological fluid in which a coloring material is dispersed or dissolved in an insulating solvent. Japanese Patent Application Publication No. 2-212149 discloses an image forming method in which an electrorheological fluid comprising a coloring material dispersed in an insulating solvent is used, and an electric field is applied to the recording medium (recording member). Japanese Patent Application Publication No. 5-4343 discloses a recording apparatus comprising a recording head which applies a recording liquid having electrorheological properties and a device for creating an electric field on the surface to which a recording liquid has been applied.

Japanese Patent Application Publication No. 2-169253 discloses technology for preventing satellite droplets by raising the viscosity of the ink by applying an electric field in the vicinity of the orifices; however, it makes no mention of the behavior of the liquid after deposition.

Japanese Patent Application Publication Nos. 2-212149 and 5-4343 disclose the use of an electrorheological fluid as an ink and the application of an electric field to the recording medium; however, the object thereof is to suppress bleeding by preventing permeation into the recording paper, and no consideration is given to landing interference, color mixing, or the like, in a case where a non-permeable recording medium (or a recording medium of low permeability) is used.

Moreover, there has been a problem in that when the ink hardens and fixes on the surface of a non-permeable recording medium (or a recording medium of low permeability), undulations remain on the printed surface (the surface of the ink) and the resulting image loses glossiness.

SUMMARY OF THE INVENTION

The present invention has been contrived in view of such circumstances, an object thereof being to provide an image forming apparatus and method which can achieve high-quality image formation by controlling the viscosity of deposited ink in order to reduce interference between liquid droplets on the recording medium, movement of the liquid, feathering, and the like, and hence cause the droplets to become fixed reliably in a satisfactory dot configuration, as well as smoothing the printed surface.

In order to attain the aforementioned object, the present invention is directed to an image forming apparatus, comprising: an ejection head which ejects ink having electrorheological properties onto a recording medium; an electric field application device which applies an electric field to a droplet of the ink deposited on the recording medium; a fixing promotion device which performs fixing promotion process for promoting fixing of the ink on the recording medium; and a timing control device which controls a time difference between an electric field application cessation timing at which an application of the electric field to the ink on the recording medium by the electric field application device is ceased and a fixing promotion process timing at which the fixing promotion process is performed by the fixing promotion device.

According to the present invention, an ink having electrorheological properties is used, and ink is ejected from an ejection head onto a recording medium. The ink droplets deposited onto the recording medium are increased in viscosity by the action of the electric field generated by an electric field application device, thereby restricting the permeation of the ink into the recording medium and excessive spreading of the dot size, while also suppressing interference between ink droplets and movement of the liquid on the surface of the recording medium. Furthermore, the time difference between the timing at which the application of electric field is ceased (electric field switch-off timing) and the timing at which a fixing promotion process is performed by the fixing promotion device (fixing promotion process timing) (in other words, the relationship between the timings in terms of which timing comes first, and the time intervals between the timings) is adjusted in such a manner that smoothing of the ink surface (print surface) proceeds when the electric field is switched off, and the ink hardens and fixes in a smoothed state. Thereby, it is possible to reduce undulations in the print surface, while also being able to form high-quality images in which there is virtually no occurrence of bleeding, color mixing, or the like, even after ceasing the electric field.

In order to adjust the time difference between electric field switch-off timing at the deposited ink and the fixing promotion process timing, it is possible to control both the electric field switch-off timing and the fixing promotion process timing, or it is possible to change the relative relationship between these timings by controlling either one of the timings.

Preferably, the image forming apparatus further comprises: a recording medium type determination device which determines a type of the recording medium, wherein the timing control device decides the electric field application cessation timing and the fixing promotion process timing according to information obtained by the recording medium type determination device.

Since the permeation of the liquid or the behavior of the ink deposited on the recording medium varies depending on conditions such as the type and thickness of the recording medium, the dielectric constant thereof, and so on, the type of recording medium is desirably ascertained by means of a recording medium type determination device, and the electric field application timing and fixing promotion process timing are adjusted in accordance with the type of medium. Accordingly, it is possible to achieve suitable control in response to the recording medium, and bleeding can be prevented effectively.

The recording medium type determination device may comprise, for example, a device which measures the reflectivity of the recording medium, or a device which reads in the type of the recording medium used from the ID, or the like, of the supply magazine. Furthermore, the recording medium type determination device is not limited to a device which obtains information automatically by means of sensors, an information reading device, or the like, and it may also constituted in such a manner that information relating to the type of recording medium or the like is inputted by a user by means of a prescribed input device or the like.

Preferably, the image forming apparatus further comprises: an ink volume judgment device which judges an ink volume from image information relating to an image to be printed, wherein the timing control device decides the electric field application cessation timing and the fixing promotion process timing according to the ink volume judged by the ink volume judgment device.

Preferably, the volume of ink to be ejected onto the recording medium can be predicted by analyzing the image information for printing, and the electric field cessation (switch-off) timing and fixing promotion process timing are controlled variably in accordance with this ink volume.

Preferably, the ink is a radiation-curable ink; and the fixing promotion device comprises a radiation irradiating device which irradiates radiation that causes the ink to harden.

In other words, the ink used is a radiation-curable ink having the property of hardening when exposed to radiation (electromagnetic waves including visible light, ultraviolet (UV) light and X-rays, an electron beam, or the like). A radiation irradiating device which causes the ink to harden is provided. Typical examples of the radiation-curable ink are: an UV-curable ink (UV ink), and an electron beam-curable ink (EB ink).

Preferably, the image forming apparatus further comprises: a conveyance device which causes the ejection head and the recording medium to move relatively to each other by conveying at least one of the ejection head and the recording medium in a relative movement direction; wherein: the electric field application device has a structure which is divided into a plurality of electrode regions aligned in the relative movement direction, electrode pairs each including a first electrode and a second electrode being disposed respectively in the electrode regions; and the timing control device changes the region in which the electric field is generated by controlling application and non-application of voltage to the electrode pairs of the respective electrode regions.

According to this mode, voltage can be applied selectively to the electrode pairs disposed in respective electrode regions, and therefore, the region in which an electric field is generated can be changed in units of the electrode regions. If the region in which the electric field is generated is lengthened in the direction of relative movement of the recording medium with respect to the ejection head, then this lengthens the electric field application section through which the ink deposited on the recording medium passes. Consequently, the time difference between the electric field switch-off timing corresponding to the position of the trailing end of the electric field generation region and the start timing of the fixing promotion process becomes shorter. Conversely, if the electric field generation region is shortened, then the electric field application section is shortened and the time difference between the electric field switch-off timing and the fixing promotion process start timing is increased. In this way, by changing the region in which the electric field is generated, it is possible to adjust the electric field cessation timing and the fixing promotion process timing.

The "electrode pair including a first electrode and a second electrode" according to the present invention generates a prescribed electric field intensity in the region peripheral to the electrode pair, when a relative potential difference is applied between the first electrode and the second electrode (in other words, when a voltage is applied to same). Consequently, in the electrode pair including a first electrode and a second electrode, naturally, one electrode is a positive electrode and the other electrode is a negative electrode, and either of the electrodes may be used as the positive or negative electrode.

Preferably, the image forming apparatus further comprises an electric field intensity control device which controls electric field intensity in such a manner that the droplet of the ink deposited on the recording medium has a prescribed viscosity.

When applying an electric field, by controlling the electric field intensity appropriately in order that the deposited ink droplets have a prescribed viscosity, it is possible to achieve a prescribed liquid state and hence interference between deposited ink droplets can be suppressed. Desirably, control is implemented in such a manner that the minimum electric field necessary in order to prevent landing interference, bleeding, and the like, is applied. Thereby, it is possible to prevent increase in the viscosity of the ink inside the ejection head, and hence the occurrence of ejection defects can be suppressed.

Preferably, the image forming apparatus further comprises a fixing intensity control device which controls intensity of the fixing promotion process performed by the fixing promotion device.

Through optimum control of the fixing intensity in accordance with conditions such as the type of recording medium, the type of ink and the volume of ink, it is possible to cause the curing reaction of the ink on the surface of the recording medium to proceed, and hence the ink can be cured and fixed reliably to a level whereby no bleeding or the like can occur.

Preferably, the electric field application device functions as an electrostatic attraction device which holds the recording medium by means of electrostatic attraction.

The electric field application device for displaying the electrorheological properties may also serve as an electrostatic attraction device which holds the recording medium stably by means of electrostatic attraction.

In order to attain the aforementioned object, the present invention is also directed to an image forming method, comprising the steps of: ejecting ink having electrorheological properties onto a recording medium from an ejection head; applying an electric field to a droplet of the ink deposited on the recording medium; performing fixing promotion process for promoting fixing of the ink on the recording medium; and controlling a time difference between a timing at which an application of the electric field to the ink on the recording medium in the electric field application step is ceased and a timing at which the fixing promotion process is performed in the fixing promotion process step.

A compositional example of an ejection head is a full line type inkjet head having a nozzle row in which a plurality of nozzles for ejecting ink are arranged through a length corresponding to the full width of the recording medium. If forming a color image, full line ink jet heads relating respectively to one of a plurality of colors are installed.

A full line type inkjet head is usually disposed in a direction that is perpendicular to the relative feed direction (relative conveyance direction) of the recording medium, but a mode may also be adopted in which the inkjet head is disposed following an oblique direction that forms a prescribed angle with respect to the direction perpendicular to the conveyance direction. Moreover, a mode may also be adopted in which a row of nozzles corresponding to the full width of the recording paper is constituted by combining a plurality of short recording head units having nozzle rows which do not reach a length corresponding to the full width of the recording medium.

The term "recording medium" indicates a medium on which an image is recorded by means of the action of the ejection head (this medium may also be called a print medium, image forming medium, image receiving medium, or the like). This term includes various types of media, irrespective of material and size, such as continuous paper, cut paper, sealed paper, resin sheets, such as OHP sheets, film, cloth, a printed circuit board on which a wiring pattern, or the like, is formed by means of an ejection head, and the like.

The conveyance device for causing the recording medium and the ejection head to move relative to each other may include a mode where the recording medium is conveyed with respect to a stationary (fixed) ejection head, or a mode where an ejection head is moved with respect to a stationary recording medium, or a mode where both the ejection head and the recording medium are moved.

According to the present invention, printing is carried out by ejecting ink having electrorheological properties from an ejection head, and bleeding, landing interference, color mixing, and the like, is prevented by applying an electric field to the ink deposited on the recording medium. Furthermore, the time difference between the timing at which the electric field is switched off and the timing at which fixing promotion process is implemented is adjusted in such a manner that smoothing of the ink surface is allowed to proceed by switching off of the electric field, and the ink is fixed in a smoothed state. Thereby, it is possible to reduce undulations in the print surface, while also being able to form high-quality images in which there is virtually no occurrence of bleeding, color mixing, or the like, even after ceasing the electric field. Accordingly, high-quality image formation can be achieved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
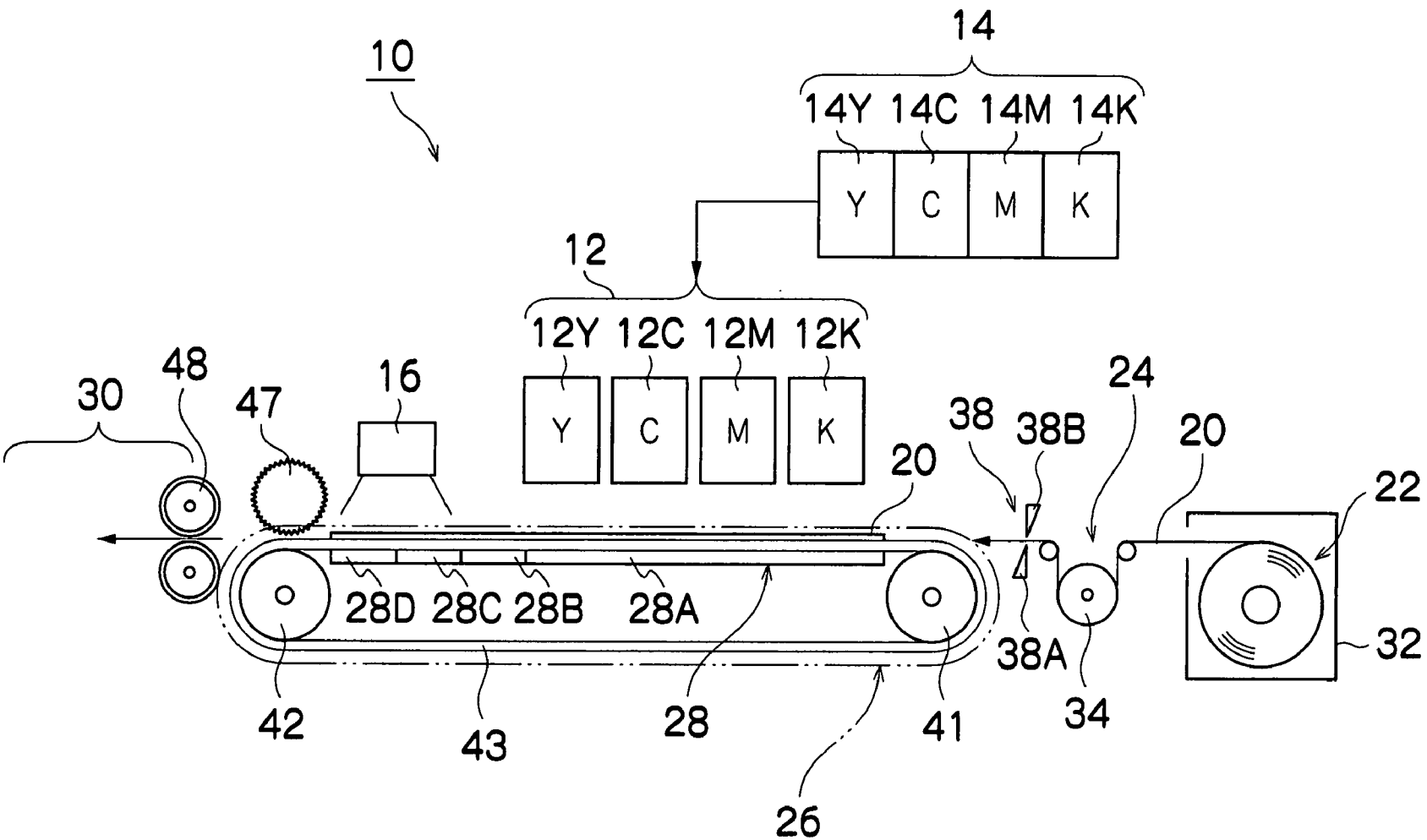
FIG. 1 is a general schematic drawing of an inkjet recording apparatus which forms one embodiment of an image forming apparatus relating to the present invention.

FIG. 1 is a general schematic drawing of an inkjet recording apparatus which forms one embodiment of an image forming apparatus according to the present invention. As shown in FIG. 1, the inkjet recording apparatus 10 comprises: a print unit 12 having a plurality of inkjet heads (hereinafter, called "print heads") 12K, 12M, 12C, and 12Y for ink colors of black (K), magenta (M), cyan (C), and yellow (Y), respectively; an ink storing and loading unit 14 for storing ink (in the present embodiment, an ultraviolet-curable ink having electrorheological properties) to be supplied to the print heads 12K, 12M, 12C and 12Y; an ultraviolet (UV) light source 16 forming a fixing promotion device; a media supply unit 22 for supplying a medium (recording medium) 20; a decurling unit 24 for removing curl in the medium 20; a conveyance unit 26 disposed facing the nozzle surfaces (ink ejection surfaces) of the print heads 12K, 12M, 12C and 12Y and the light ejection surface of the UV light source 16, for conveying the medium 20 while keeping the medium 20 flat; an electrode unit 28 attached to the conveyance unit 26, for applying an electric field to the ink deposited on the medium 20; and a paper output unit 30 for outputting recorded medium 20 (printed matter) to the exterior.

The ink storing and loading unit 14 has ink tanks 14K, 14M, 14C, 14Y for storing the inks of K, M, C and Y to be supplied to the heads 12K, 12M, 12C, and 12Y, and the tanks are connected to the heads 12K, 12M, 12C, and 12Y by means of prescribed channels. The ink storing and loading unit 14 has a warning device (for example, a display device or an alarm sound generator) for warning when the remaining amount of any ink is low, and has a mechanism for preventing loading errors among the colors.

In the present embodiment, an electrorheological fluid obtained by imparting an ultraviolet-curable ink with electrorheological properties is used as the printing ink. An electrorheological fluid is a fluid in which the apparent viscosity rises instantaneously when an electric field is applied. The change in viscosity is reversible by switching the electric field on and off. There are two types of electrorheological fluids: dispersed fluids and uniform fluids.

A dispersed type fluid is one in which dielectric micro-particles are dispersed in a liquid inside an electrically insulating solvent. This fluid behaves in such a manner that when no electric field is applied, the micro-particles remain in a dispersed state and the viscosity of the fluid is low, but when an electric field is applied, the polarized particles form chain-like structures ("bridges") linked in the direction of the electric field, and these bridges act so as to increase the viscosity of the fluid.

A uniform type electrorheological fluid has anisotropic properties in which molecules or domains are oriented in the direction of the electric field, such as liquid crystals, or the like. Since uniform type electrorheological fluids currently display little change in viscosity, it is thought that dispersed type electrorheological fluids are more suitable for use in inkjet printers.

In the present embodiment, a radiation-curable ink is imparted with electrorheological properties, and an ink of this kind may be created, for example, by dispersing solid micro-particles (silica gel, starch, dextrin, carbon, gypsum, gelatin, alumina, cellulose, mica, zeolite, kaolite, or the like) in a liquid containing at least a radiation-curable monomer and a polymerization initiator, by using the actual pigment micro-particles as a dispersant for creating an electrorheological effect, by forming the dye or pigment into micro-capsules, providing insulation on the surface thereof, and using these micro-capsules as a dispersant for creating an electrorheological effect, or by combining a uniform type electrorheological fluid.

In FIG. 1, a magazine 32 for rolled paper (continuous paper) is shown as an example of the media supply unit 22; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of media can be used, it is preferable that an information recording medium such as a bar code and a wireless tag containing information about the type of medium is attached to the magazine, and by reading the information contained in the information recording medium with a predetermined reading device, the type of medium to be used is automatically determined, and ink droplet ejection is controlled so that the ink droplets are ejected in an appropriate manner in accordance with the type of medium.

The medium 20 delivered from the media supply unit 22 retains curl due to having been loaded in the magazine 32. In order to remove the curl, heat is applied to the medium 20 in the decurling unit 24 by a heating drum 34 in the direction opposite from the curl direction in the magazine 32. The heating temperature at this time is preferably controlled so that the medium 20 has a curl in which the surface on which the print is to be made is slightly round outward.

In the case of the configuration in which roll paper is used, a cutter 38 is provided as shown in FIG. 1, and the continuous paper is cut into a desired size by the cutter 38. The cutter 38 has a stationary blade 38A, of which length is not less than the width of the conveyor pathway of the medium 20, and a round blade 38B, which moves along the stationary blade 38A. The stationary blade 38A is disposed on the reverse side of the printed surface of the medium 20, and the round blade 38B is disposed on the printed surface side across the conveyor pathway. When cut papers are used, the cutter 38 is not required.

After decurling in the decurling unit 24, the cut medium 20 is delivered to the conveyance unit 26. The conveyance unit 26 has a configuration in which an endless belt 43 having minimal electrical conductivity is set around rollers 41 and 42 in such a manner that at least the portion of the endless belt 43 facing the nozzle faces of the print heads 12K, 12M, 12C and 12Y forms a horizontal plane (flat plane).

The minimally conductive belt 43 has a broader width than the medium 20, and an electrode unit 28 is disposed on the rear side of the portion of the belt which supports the medium 20. Although described in more detail below, by applying a direct current (DC) high voltage to the electrode unit 28 by means of a DC high voltage generator 78 (not shown in FIG. 1, but shown in FIG. 7), the medium 20 is attracted to and held on the minimally conductive belt 43 due to the electrostatic force, and an electric field is applied to the ink deposited on the medium 20.

The minimally conductive belt 43 is driven in the counter-clockwise direction in FIG. 1 by the motive force of a motor 138 (not shown in FIG. 1, but shown in FIG. 9) being transmitted to at least one of the rollers 41 and 42, which the belt 43 is set around, and the medium 20 is thus conveyed from right to left in FIG. 1.

Each of the heads 12K, 12M, 12C and 12Y is a full line head having a length corresponding to the maximum width of the medium 20 used with the inkjet recording apparatus 10, and comprising a plurality of nozzles for ejecting ink arranged on a nozzle face through a length exceeding at least one edge of the maximum-size medium 20 (namely, the full width of the printable range).

The print heads 12K, 12M, 12C and 12Y are arranged in color order (black (K), magenta (M), cyan (C), yellow (Y)) from the upstream side in the feed direction of the medium 20, and these respective heads 12K, 12M, 12C and 12Y are fixed extending in a direction substantially perpendicular to the conveyance direction of the medium 20.

A color image can be formed on the medium 20 by ejecting inks of different colors from the print heads 12K, 12M, 12C and 12Y, respectively, onto the medium 20 while the medium 20 is conveyed at a uniform speed by the conveyance unit 26.

By adopting a configuration in which full line heads 12K, 12M, 12C and 12Y having nozzle rows covering the full paper width are provided for each separate color in this way, it is possible to record an image on the full surface of the medium 20 by performing just one operation of moving the medium 20 relatively with respect to the heads 12K, 12M, 12C and 12Y in the paper conveyance direction (the sub-scanning direction), (in other words, by means of one sub-scanning action). The inkjet recording apparatus 10 of a single-pass type of this kind is able to print at high speed in comparison with a shuttle scanning system in which an image is printed by moving a recording head back and forth reciprocally in the main scanning direction, and hence print productivity can be improved.

Although the configuration with the KMCY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The UV light source 16 disposed on the downstream side of the print unit 12 has a length corresponding to the maximum width of the medium 20, similarly to the print heads, and is disposed extending in a direction substantially perpendicular to the conveyance direction of the medium 20. For example, the UV light source 16 is constituted by a configuration of UV light-emitting diode (LED) elements or UV laser diode (LD) elements arranged in a line. According to this composition, since light emission can be controlled selectively in each individual light-emitting element, it is possible readily to adjust the number of light emitting elements that light up, and the amount of light generated, and hence a prescribed irradiation range and light volume (intensity) can be achieved in the UV irradiation area. Of course, it is also possible to use a UV lamp, instead of the UV LED element array or UV LD element array.

The UV light source 16 irradiates UV light for promoting the curing of the ink deposited onto the medium 20. It is not necessary to cure or fix the ink droplets ejected onto the medium 20 completely (in other words, to a state where the curing reaction has completed). Furthermore, desirably, when the medium has passed the UV light source 16, curing and fixing should be advanced to such a degree that no degradation of the image is caused by subsequent handling (in the downstream steps). This handling means, for example, (1) rubbing of the image surface against the rollers, conveyance guides, and the like, in the conveyance steps downstream of the second hardening device, (2) rubbing between prints in the print stacking section, and (3) rubbing of a finished print against various objects when it is actually handled for use.

In this way, the medium 20 which has passed by the UV light source 16 (the generated printed object) is outputted from the paper output unit 30, by means of a toothed idle roller 47 and a nip roller 48. Although not shown in FIG. 1, the paper output unit 30 is provided with a sorter for collecting images according to print orders.

The electrode unit 28 attached to the conveyance unit 26 is divided into a plurality of regions (in the present embodiment, four regions, 28A to 28D), from the upstream side toward the downstream side in terms of the paper conveyance direction, and the application of voltage (on/off switching) can be controlled independently in each region.

The first electrode region indicated by the reference numeral 28A is a region corresponding to the print region (ink ejection region) of the print unit 12. The second to fourth electrode regions indicated by reference numerals 28B to 28D are disposed in a range from the trailing end of the printing region until the irradiation region of the UV light source 16. During a printing operation, an electric field is generated by applying a voltage to at least the first electrode region 28A. Furthermore, it is also possible to extend the area in which the electric field is generated, toward the downstream side, by applying voltage selectively to the second to fourth electrode regions 28B to 28D, in accordance with conditions such as the type of medium, type of ink, and the ejected ink volume.

In other words, by controlling the on/off switching of the voltage applied to the second to fourth electrode regions 28B to 28D, it is possible to adjust the time period during which an electric field is applied to the ink deposited on the medium 20 (in other words, the timing at which the application of an electric field to the ink deposited on the medium 20 is switched off, as the medium 20 is conveyed by the conveyance unit 26). The first electrode region 28A is called a "fixed zone", in the sense that it is a region where an electric field is always generated during printing, and the range of the second to fourth electrode regions 28B to 28D is called an "on/off control zone", in the sense that an electric field can be generated selectively in these regions, in accordance with the circumstances.

In the inkjet recording apparatus 10 according to the present embodiment, it is possible to adjust the time difference between the time at which the application of electric field to the ink deposited on the medium 20 traveling at constant speed is switched off, and the time at which UV light is irradiated onto the ink by the UV light source 16, by changing the area in which the electric field is generated by means of the on/off control zone (28B to 28D).

Structure of the Head

Next, the structure of a head will be described. The heads 12K, 12M, 12C and 12Y of the respective ink colors have the same structure, and a reference numeral 50 is hereinafter designated to any of the heads.

Figure 2A:
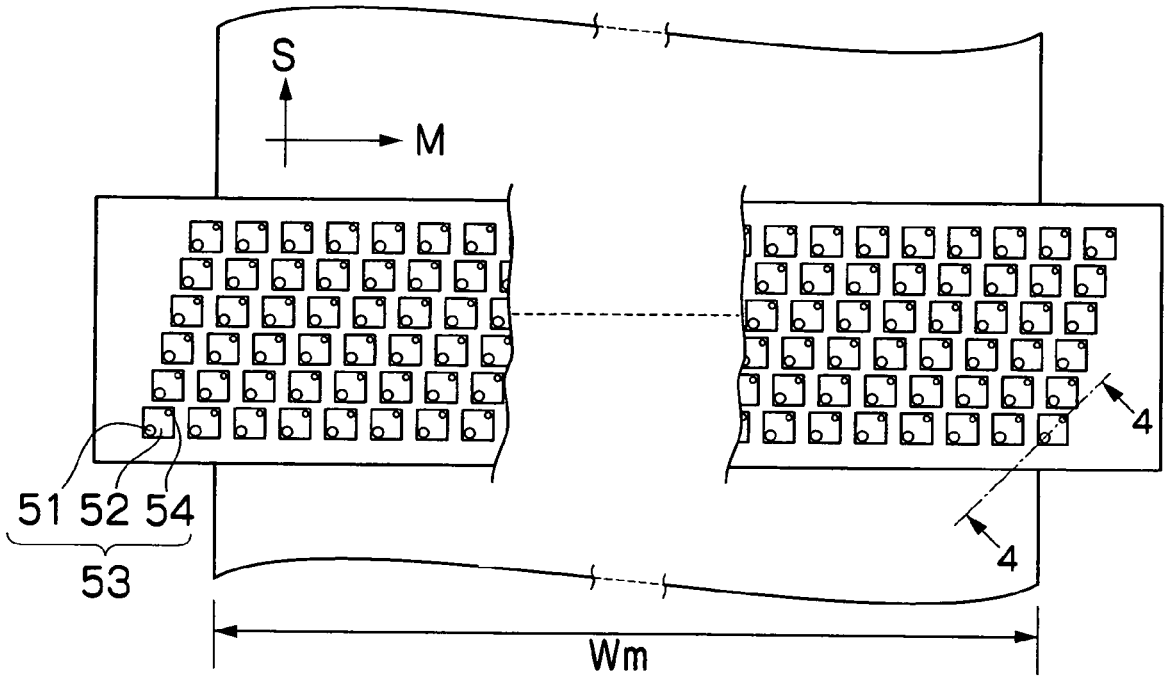
FIGS. 2A and 2B are plan view perspective diagrams showing an example of the composition of a print head.
Figure 2B:
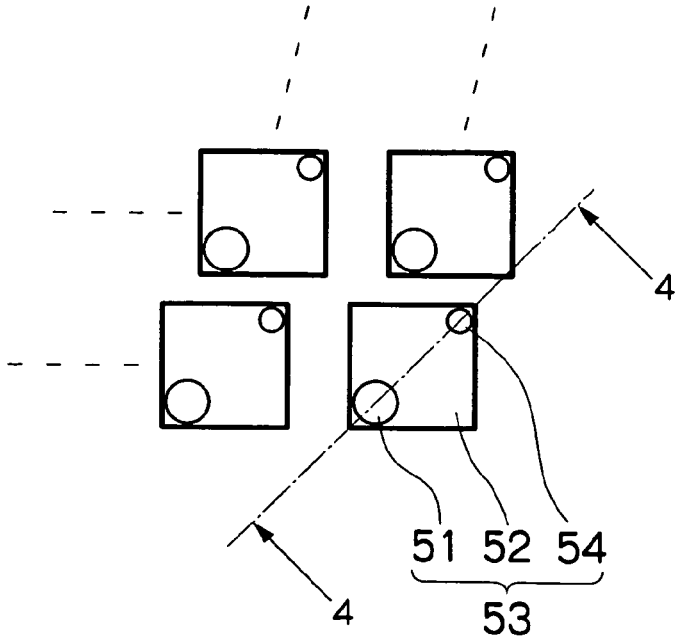
Figure 3:
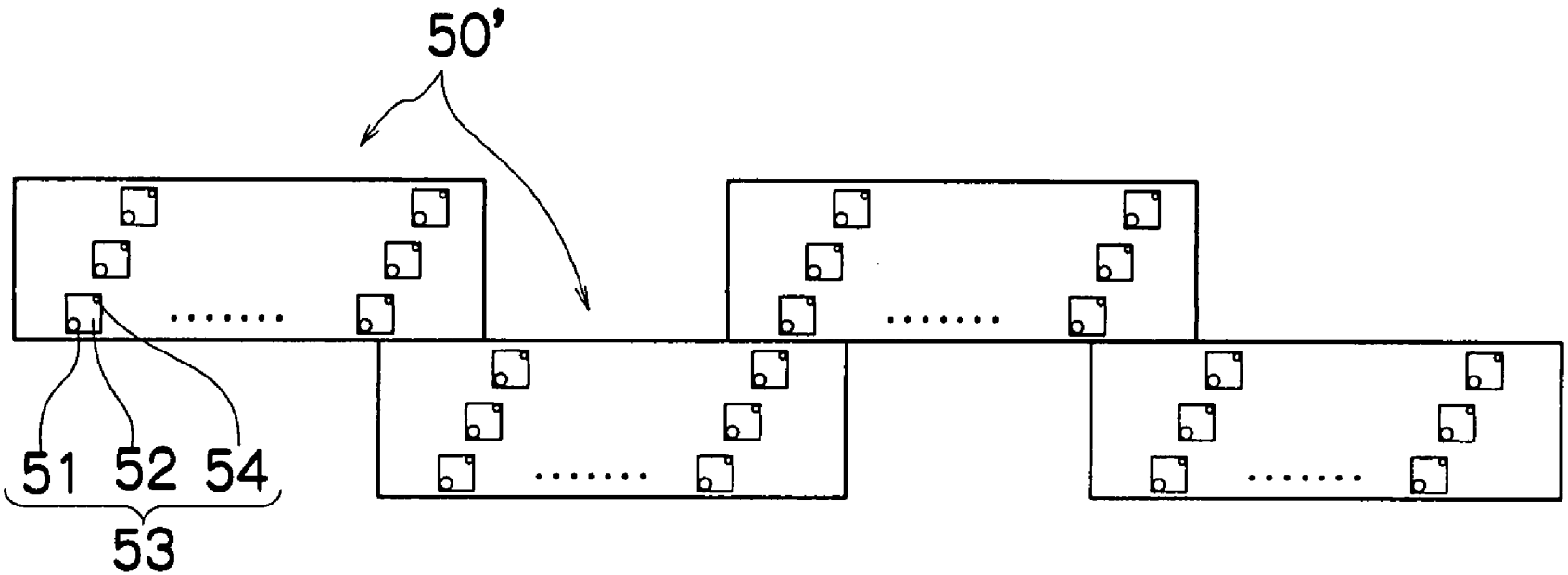
FIG. 3 is a plan view perspective diagram showing a further example of the composition of a full line inkjet head.
Figure 4:
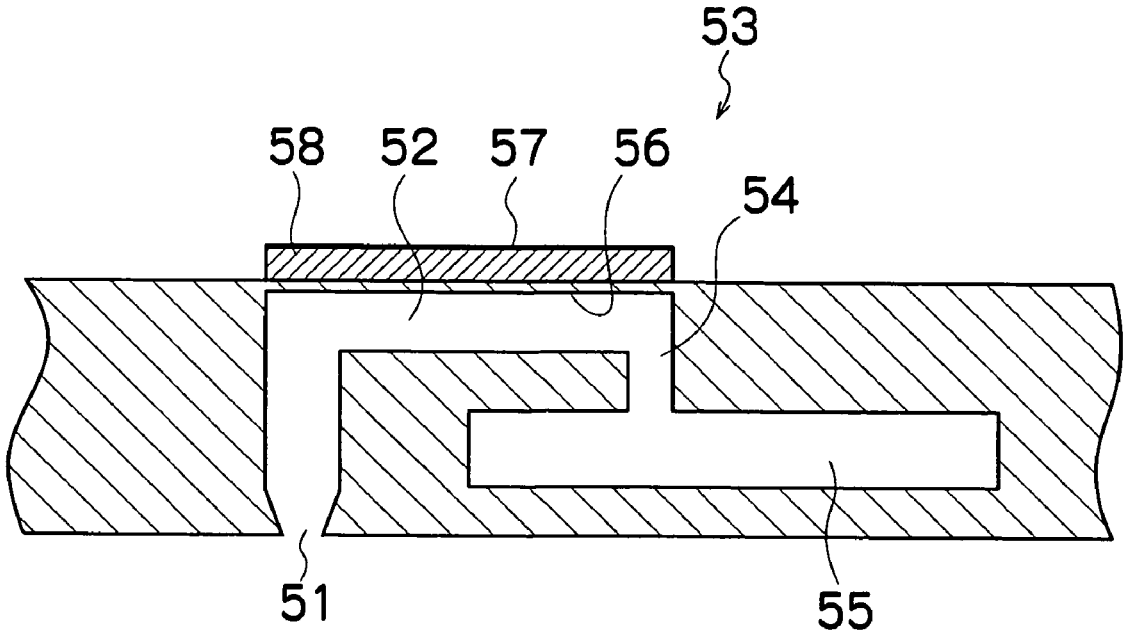
FIG. 4 is a cross-sectional diagram showing the three-dimensional composition of a liquid droplet ejection element (an ink chamber unit corresponding to a nozzle)

FIG. 2A is a perspective plan view showing an example of the configuration of the head 50, FIG. 2B is an enlarged view of a portion thereof, FIG. 3 is a perspective plan view showing another example of the configuration of the head 50, and FIG. 4 is a cross-sectional view taken along the line 4-4 in FIGS. 2A and 2B, showing the inner structure of a droplet ejection element (an ink chamber unit for one nozzle 51).

The nozzle pitch in the head 50 should be minimized in order to maximize the density of the dots printed on the surface of the medium 20. As shown in FIGS. 2A and 2B, the head 50 according to the present embodiment has a structure in which ink chamber units (droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The invention is not limited to the present embodiment of a mode for constituting nozzle rows equal to or exceeding a length corresponding to the full width Wm of the medium 20 in a direction (indicated by arrow M; main scanning direction) which is substantially perpendicular to the feed direction of the medium 20 (indicated by arrow S; sub-scanning direction). For example, instead of the composition in FIG. 2A, as shown in FIG. 3, a line head having nozzle rows of a length corresponding to the entire width of the medium 20 can be formed by arranging and combining, in a staggered matrix, short head units 50' each having a plurality of nozzles 51 arrayed in a two-dimensional fashion.

As shown in FIGS. 2A and 2B, the planar shape of the pressure chamber 52 provided for each nozzle 51 is substantially a square, and an outlet to the nozzle 51 and an inlet of supplied ink (supply port) 54 are disposed in both corners on a diagonal line of the square.

As shown in FIG. 4, each pressure chamber 52 is connected to a common channel 55 through the supply port 54. The common channel 55 is connected to an ink tank 60 (not shown in FIG. 4, but shown in FIG. 6), which is a base tank that supplies ink, and the ink supplied from the ink tank 60 is delivered through the common flow channel 55 in FIG. 4 to the pressure chambers 52.

An actuator 58 provided with an individual electrode 57 is bonded to a pressure plate 56 (a diaphragm that also serves as a common electrode) which forms the ceiling of the pressure chamber 52. When a drive voltage is applied to the individual electrode 57, then the actuator 58 deforms, thereby changing the volume of the pressure chamber 52. This causes a pressure change which results in ink being ejected from the nozzle 51. When ink is ejected, new ink is supplied to the pressure chamber 52 from the common flow channel 55 through the supply port 54. A piezoelectric body, such as a piezo element, is suitable as the actuator 58.

Figure 5:
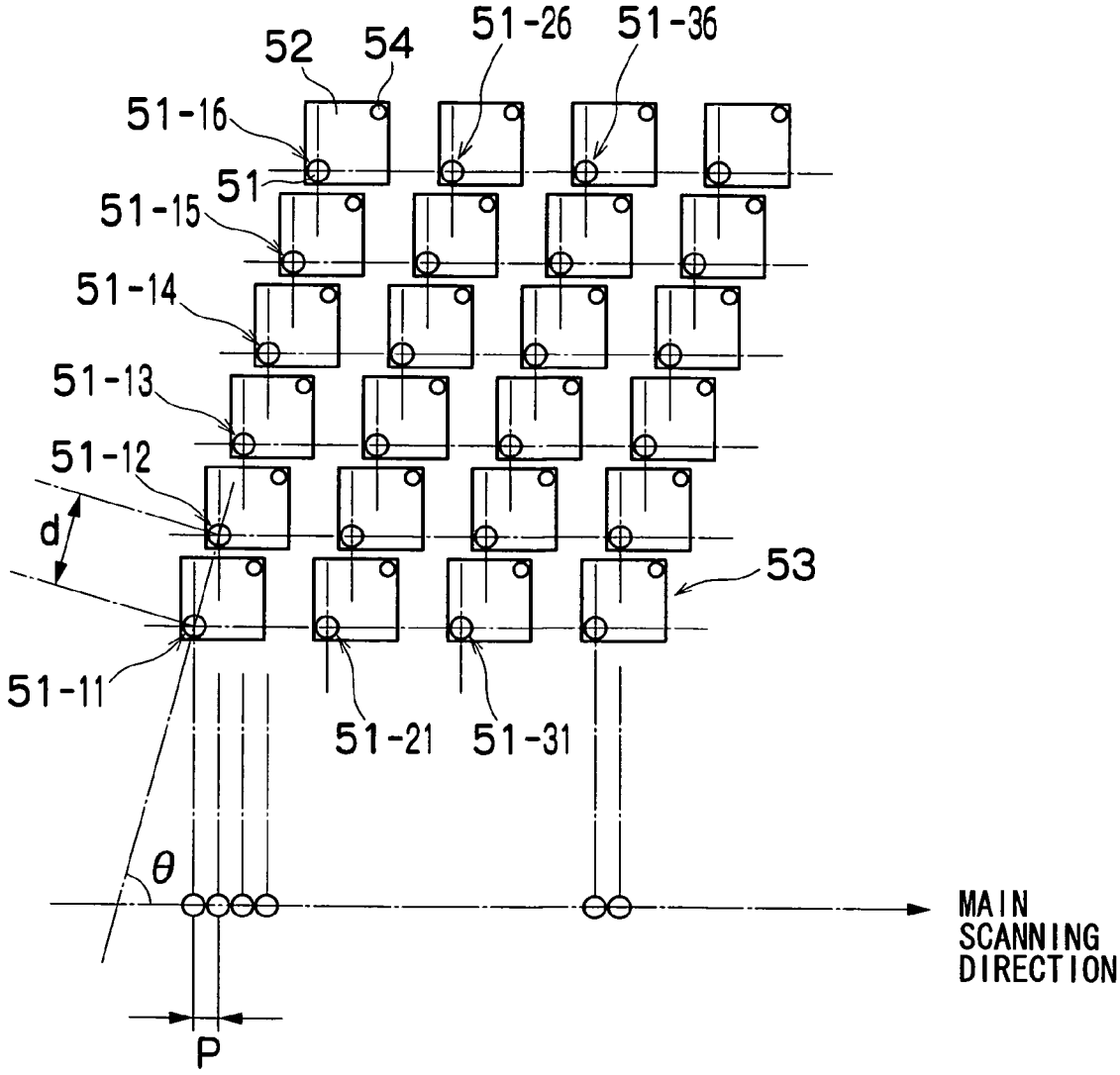
FIG. 5 is an enlarged view showing a nozzle arrangement in the print head shown in FIGS. 2A and 2B.

As shown in FIG. 5, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected to an alignment in the main scanning direction is d×cos θ, and hence it is possible to treat the nozzles 51 as they are arranged linearly at a uniform pitch of P. By adopting a composition of this kind, it is possible to achieve nozzle rows of high density.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the medium 20 by sequentially driving the nozzles 51-11, 51-12, . . . , 51-16 in accordance with the conveyance velocity of the medium 20.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

In implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Configuration of Ink Supply System

Figure 6:
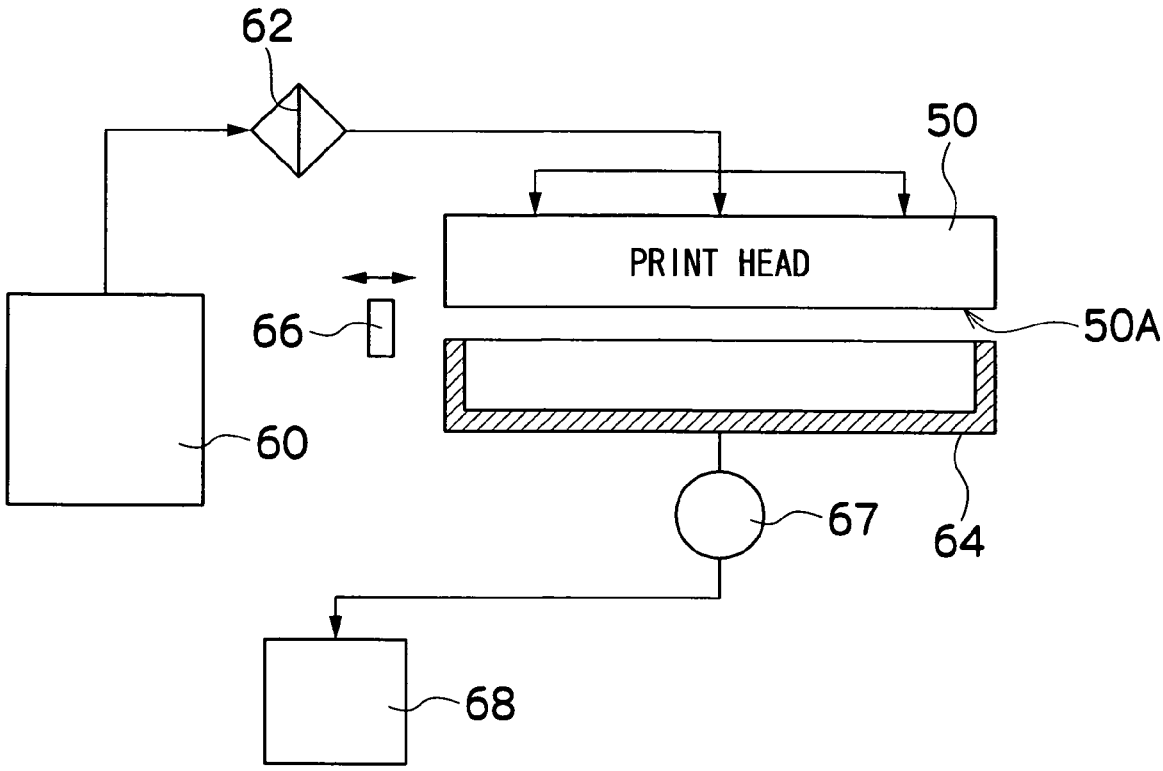
FIG. 6 is a schematic drawing showing the composition of an ink supply system in the inkjet recording apparatus according to the present embodiment.

FIG. 6 is a schematic drawing showing the configuration of the ink supply system in the inkjet recording apparatus 10. The ink tank 60 is a base tank that supplies ink to the head 50 and is set in the ink storing and loading unit 14 described with reference to FIG. 1. The ink tank 60 in FIG. 6 is equivalent to the ink storing and loading unit 14 in FIG. 1 described above. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 62 for removing foreign matters and bubbles is disposed between the ink tank 60 and the head 50 as shown in FIG. 6. The filter mesh size in the filter 62 is preferably equivalent to or less than the diameter of the nozzle. Although not shown in FIG. 6, it is preferable to provide a sub-tank integrally to the print head 50 or nearby the head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit (restoring device) including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face 50A is thereby covered with the cap 64.

The cleaning blade 66 is composed of rubber or another elastic member, and can slide on the nozzle surface 50A (nozzle plate surface) of the print head 50 by means of a blade movement mechanism (not shown). If there are ink droplets or foreign matter adhering to the nozzle plate surface, then the nozzle plate surface is wiped clean by causing the cleaning blade 66 to slide over the nozzle plate.

During printing or standby, when the frequency of use of specific nozzles is reduced and ink viscosity increases in the vicinity of the nozzles, a preliminary discharge is made to eject the degraded ink toward the cap 64 (also used as an ink receiver).

When a state in which ink is not ejected from the head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state (in a viscosity range that allows ejection by the operation of the actuator 58) the actuator 58 is operated to perform the preliminary discharge to eject the ink of which viscosity has increased in the vicinity of the nozzle toward the ink receptor. After the nozzle surface is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

On the other hand, if air bubbles become intermixed into the nozzle 51 or pressure chamber 52, or if the rise in the viscosity of the ink inside the nozzle 51 exceeds a certain level, then it may not be possible to eject ink in the preliminary ejection operation described above. In cases of this kind, a cap 64 forming a suction device is pressed against the nozzle surface 50A of the print head 50, and the ink inside the pressure chambers 52 (namely, the ink containing air bubbles of the ink of increased viscosity) is suctioned by a suction pump 67. The ink suctioned and removed by means of this suction operation is sent to a recovery tank 68. The ink collected in the recovery tank 68 may be used, or if reuse is not possible, it may be discarded.

Since the suctioning operation is performed with respect to all of the ink in the pressure chambers 52, it consumes a large amount of ink, and therefore, desirably, preliminary ejection is carried out while the increase in the viscosity of the ink is still minor. The suction operation is also carried out when ink is loaded into the print head 50 for the first time, and when the head starts to be used after being idle for a long period of time.

Structure of Electrode Unit

Figure 7:
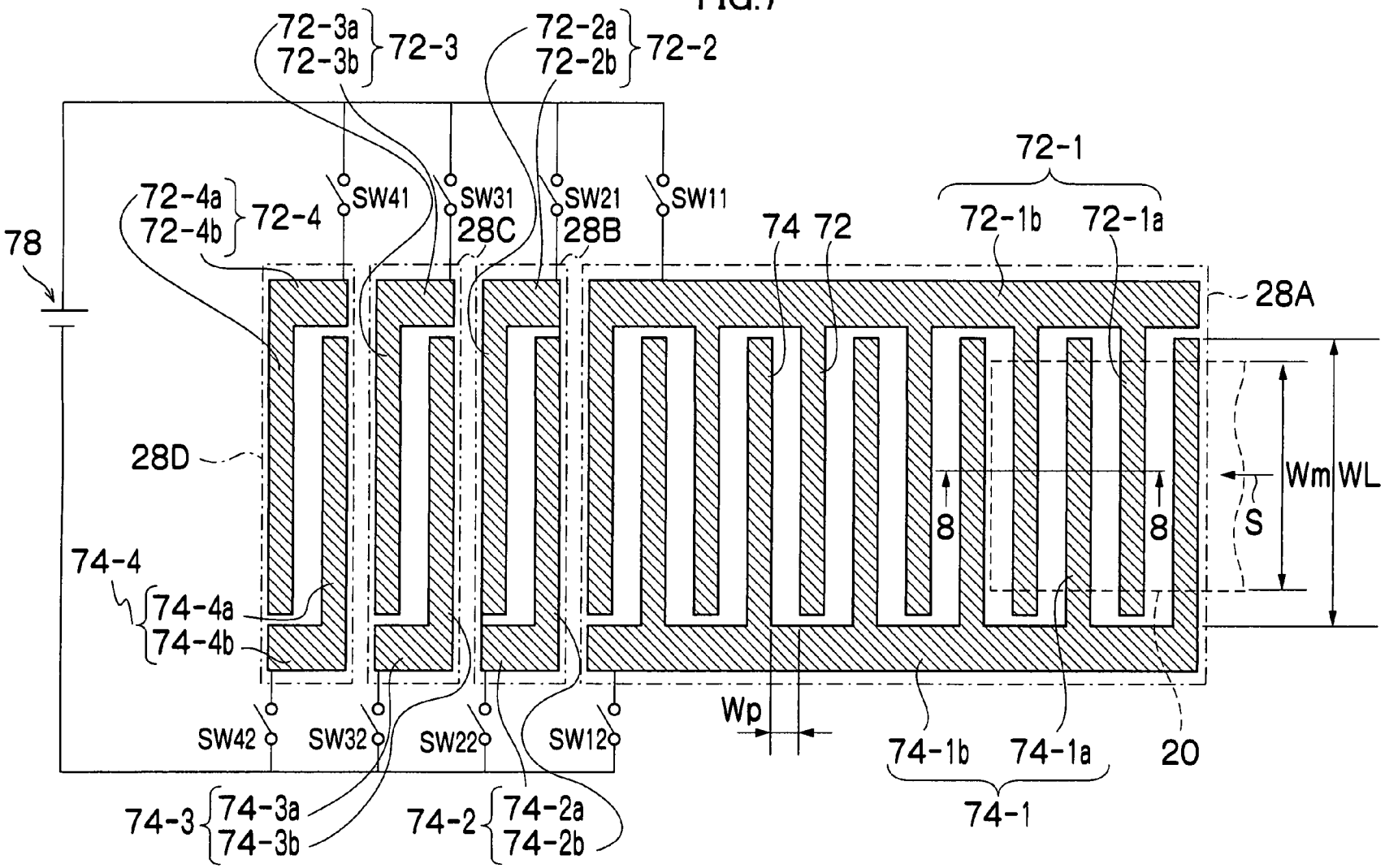
FIG. 7 is a plan view schematic drawing showing one example of an electrode arrangement structure in an electrode unit.

FIG. 7 is a plan diagram showing one example of the structure of an electrode arrangement in the electrode unit 28 described in FIG. 1. As shown in FIG. 7, the electrode unit 28 has a structure in which bar-shaped positive electrodes 72 and negative electrodes 74 extending substantially in parallel with a direction perpendicular to the conveyance direction of the medium 20 (direction S) are arranged alternately at a prescribed electrode pitch Wp in the medium conveyance direction. In FIG. 7, in order to simplify the drawing, the number of electrodes is reduced and a schematic illustration is provided, in practice, a large number of electrodes are arranged in a dense configuration.

The rod-shaped positive electrodes 72 and negative electrodes 74 are each formed to a longer dimension WL than the width Wm of the medium 20, in such a manner that they apply a uniform electric field to the ink deposited on the medium 20.

As described with respect to FIG. 1, the electrode unit 28 is divided into four independent electrode groups corresponding to the first electrode region 28A to the fourth electrode region 28D. In other words, the respective electrode regions (28A to 28D) each have pairs of positive and negative electrode patterns 72-*j*, 74-*j* (j=1, 2, 3, 4), and are connected to a DC high voltage generator via switches SWj1 and SWj2, in such a manner that the application of voltage can be switched on and off independently, to each electrode region.

The first electrode region 28A comprises a positive electrode pattern 72-1 formed in a comb shape, in which one end of each of a plurality of bar-shaped positive electrodes 72-1*a* (the upper ends thereof in FIG. 7) are connected to a common base electrode section 72-1*b*, and a negative electrode pattern 74-1 formed in a comb shape, in which one end of each of a plurality of bar-shaped negative electrodes 74-1*a* (the upper ends thereof in FIG. 7) are connected to a common base electrode section 74-1*b*. The positive electrode pattern 72-1 and the negative electrode pattern 74-1 are disposed in such a manner that the sides of the bar-shaped electrodes formed in comb shapes are positioned respectively alongside each other. The positive side base electrode section 72-1*b* is connected to the positive electrode of the DC high voltage generator 78 via a switch SW11. The negative side base electrode section 74-1*b* is connected to the negative electrode of the DC high voltage generator 78 via a switch SW12.

The respective electrode arrangement structures in the second electrode region 28D to the fourth electrode region 28D are generally similar to that in the first electrode region 28A, and only differ from the first electrode region 28A in respect of the number of bar-shaped positive electrodes 72-2*a* and bar-shaped negative electrodes 74-2*a*. FIG. 7 shows a simplified configuration, but in practice, the second electrode region 28B to the fourth electrode region 28D comprise pairs of positive and negative electrode patterns forming comb shapes.

Furthermore, as shown in FIG. 7, the positive side base electrode section 72-2*b* in the second electrode region 28B is connected to the positive electrode of the DC high voltage generator 78 via a switch SW21, and the negative side base electrode section 74-2*b* is connected to the negative electrode of the DC high voltage generator 78 via a switch SW22.

Similarly, the positive side base electrode section 72-3*b* in the third electrode region 28C is connected to the positive electrode of the DC high voltage generator 78 via a switch SW31, and the negative side base electrode section 74-3*b* is connected to the negative electrode of the DC high voltage generator 78 via a switch SW32.

The positive side base electrode section 72-4*b* in the fourth electrode region 28C is connected to the positive electrode of the DC high voltage generator 78 via a switch SW41, and the negative side base electrode section 74-4*b* is connected to the negative electrode of the DC high voltage generator 78 via a switch SW42.

Figure 8:
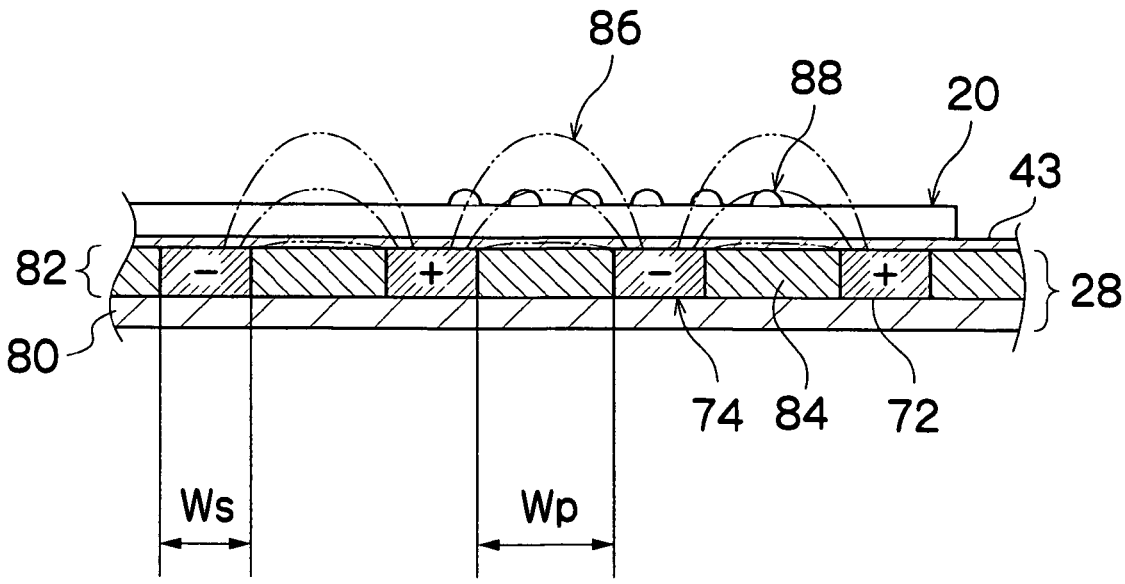
FIG. 8 is a cross-sectional view along line 8-8 in FIG. 7.

FIG. 8 is a cross-sectional view along line 8-8 in FIG. 7. As shown in FIG. 8, the electrode unit 28 is positioned below the minimally conductive belt 43 which supports the medium 20. The electrode unit 28 forms a layered structure in which an electrode layer 82 is provided on top of an insulating supporting layer 80. The respective positive and negative electrodes 72 and 74 described in FIG. 7 are formed within the same plane in the electrode layer 82. Furthermore, the spaces between the electrodes 72 and 74 in the electrode layer 82 are filled with an insulating material 84, thereby providing an electrical insulation between the electrodes.

The minimally conductive belt 43 covers the upper surface of the electrode unit 28 and makes contact with the rear surface of the medium 20. Desirably, the electrical resistivity of the minimally conductive belt 43 is approximately $10^8$ to $10^{12}$ Ωcm. Furthermore, desirably, the thickness of the minimally conductive belt 43 is approximately 0.01 mm to 10 mm.

Since the minimally conductive belt 43 covers the surface of the electrode layer 82 adjacent to the medium 20, it serves to prevent human injury resulting from electrical shock, or the like, as well as protecting the positive and negative electrodes 72 and 74. Furthermore, the minimally conductive belt 43 is prevented from remaining in a charged state when no printing operation is being performed, in other words, when the power supply is switched off.

When a prescribed voltage from the DC high voltage generator 78 shown in FIG. 7 is applied between the electrodes 72 and 74, an electric field is generated between the adjacent electrodes 72 and 74, as shown in FIG. 8. In FIG. 8, the lines of electric force 86 of the electric field generated in this case are shown by double-dotted broken lines. As shown in FIG. 8, the lines of electric force 86 of the electric field created between mutually adjacent electrodes 72 and 74 form approximately arc-shaped lines, and an electric field is also created above the print surface of the medium 20. Consequently, an electric field is applied to the ink 88 deposited on the medium 20. In this case, a minimal current flows through the ink 88 deposited on the medium 20, via the minimally conductive belt 43 and the medium 20. In this way, an electrorheological effect is produced in the deposited ink 88 on the medium 20, thereby increasing the viscosity of the deposited ink 88. This state of increased viscosity due to the aforementioned electrorheological effect is sustained while the electric field continues to be applied. Accordingly, the deposited ink 88 is maintained in an approximately hemispherical-shaped liquid state, and landing interference, bleeding due to permeation, intermixing between colors, and the like, are suppressed.

In the present embodiment, the intensity of the electric field applied to the medium 20 is dependent on the electrode pitch Wp between the adjacently disposed positive electrodes 72 and the negative electrodes 74, and the voltage applied between the electrodes. At a constant applied voltage, the smaller the electrode pitch Wp, the greater the intensity of the electric field at the medium 20. Consequently, from the viewpoint of reducing the applied voltage, it is desirable that the electrode pitch Wp should be small, and more desirable that it is approximately 0.1 mm to 20 mm.

Furthermore, the smaller the thickness of the respective electrodes 72 and 74 (namely, electrode width) Ws, the intensity distribution of the electric field created on the medium 20 is substantially uniform. Therefore, desirably, the electrode width Ws is small, and more desirably, it approximately 0.01 mm to 10 mm.

Experimentation reveals that when the intensity of the electric field applied to the medium 20 lies within the range of 0.1 kV/mm to 10 kV/mm, a large electrorheological effect is obtained with respect to the deposited ink droplets on the medium 20. Therefore, desirably, the electrode pitch Wp, electrode width Ws and applied voltage are set in such a manner that the intensity of the electric field applied to the medium 20 lies in the range of 0.1 kV/mm to 10 kV/mm.

Description of Control System

Figure 9:
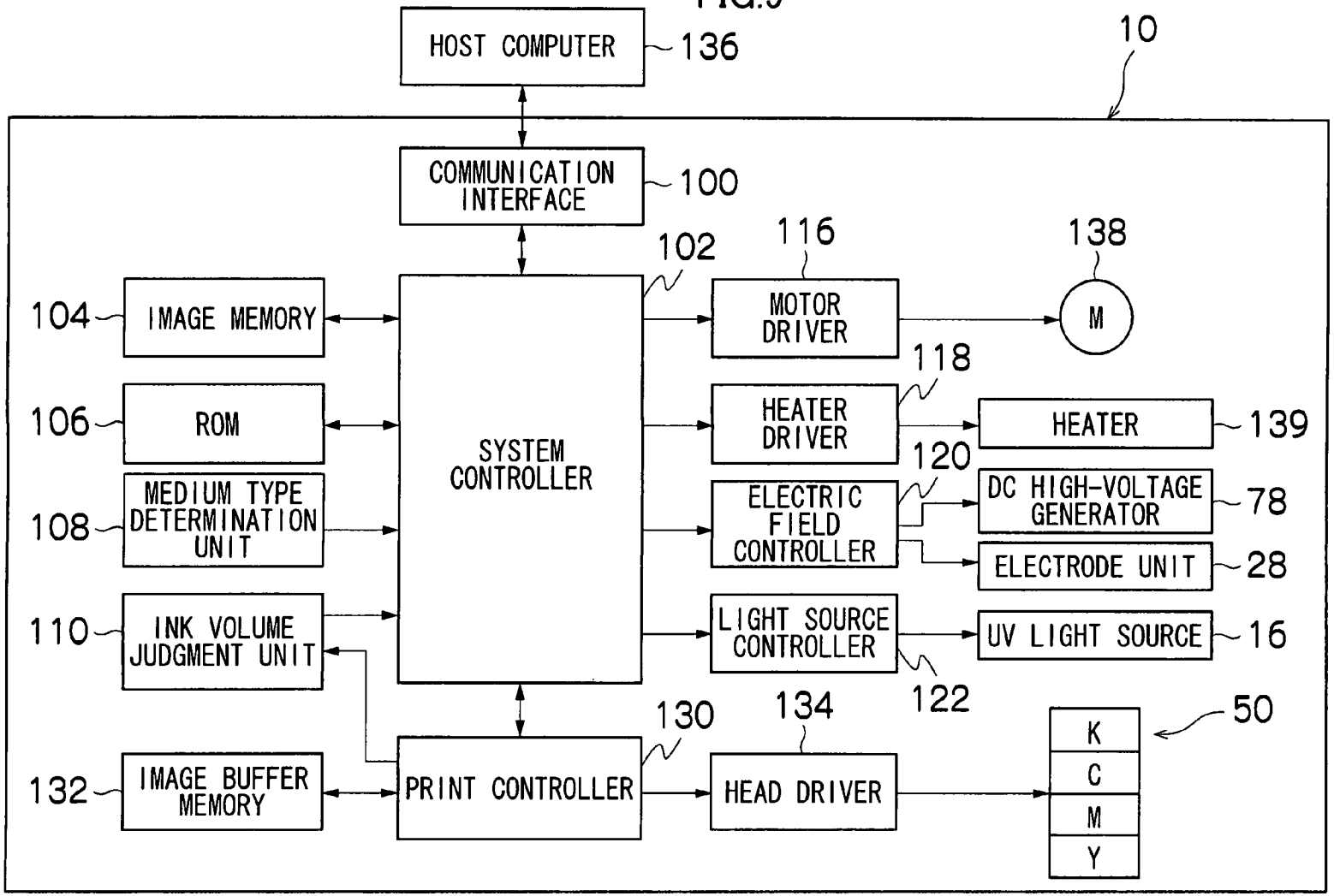
FIG. 9 is a principal block diagram showing the system composition of an inkjet recording apparatus according to the present embodiment.

FIG. 9 is a principal block diagram showing the system composition of the inkjet recording apparatus 10. The inkjet recording apparatus 10 comprises a communications interface 100, a system controller 102, an image memory 104, a ROM 106, a medium type determination unit 108, an ink volume judgment unit 110, a motor driver 116, a heater driver 118, an electric field control unit 120, a light source controller 122, a print controller 130, an image buffer memory 132, a head driver 134, and the like.

The communication interface 100 is an interface unit for receiving image data sent from a host computer 136. A serial interface such as USB, IEEE1394, Ethernet, wireless network, or a parallel interface such as a Centronics interface may be used as the communication interface 100. A buffer memory (not shown) may be mounted in this portion in order to increase the communication speed.

The image data sent from the host computer 136 is received by the inkjet recording apparatus 10 through the communication interface 100, and is temporarily stored in the image memory 104. The image memory 104 is a storage device for temporarily storing images inputted through the communication interface 100, and data is written and read to and from the image memory 104 through the system controller 102. The image memory 104 is not limited to a memory composed of semiconductor elements, and a hard disk drive or another magnetic medium may be used.

The system controller 102 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations.

More specifically, the system controller 102 is a control unit which controls the various sections, such as the communications interface 100, image memory 104, motor driver 116, heater driver 118, electric field controller 120, light source controller 122, printer controller 130, and the like, and as well as controlling communications with the host computer 136 and writing and reading to and from the image memory 104, it also generates control signals for controlling the motor 138 and heater 139 of the conveyance system.

The program executed by the CPU of the system controller 102 and the various types of data which are required for control procedures are stored in the ROM 106. The ROM 106 may be a non-writeable storage device, or it may be a rewriteable storage device, such as an EEPROM. The image memory 104 is used as a temporary storage region for the image data, and it is also used as a program development region and a calculation work region for the CPU.

The medium type determination unit 108 includes a device which acquires information relating to the medium type, and a device which determines the type, porosity, size, and the like, of the medium 20. This section uses, for example, a device for reading in information such as a bar code attached to the magazine 32 in the media supply unit 22 shown in FIG. 1, or a sensor disposed at a suitable position in the paper conveyance path (a paper width determination sensor, a sensor for determining the thickness of the paper, a sensor for determining the optical reflectivity of the paper, and so on). A suitable combination of these elements may also be used. Furthermore, it is also possible to adopt a composition in which information relating to the paper type, porosity, size, or the like, is specified by means of an input via a prescribed user interface, instead of or in conjunction with such automatic determining devices.

The ink volume judgment unit 110 is a device which determines the volume of the ejected ink. The ink volume judgment unit 110 determines the volume of the ink droplets ejected onto a prescribed image region, from the dot data generated by the print controller 130, on the basis of the image data to be printed. Furthermore, information relating to the ink type, and the like, may also be appended. For the device for acquiring information on the ink type, and the like, it is possible to use, for example, a device which reads in ink properties information from the shape of the cartridge in the ink tank 60 (see FIG. 6) (a specific shape which allows the ink type to be identified), or from a bar code or IC chip incorporated into the cartridge. Besides this, it is also possible for an operator to input the required information by means of a user interface.

The information obtained from the medium type determination unit 108 and the ink volume judgment unit 110 shown in FIG. 9 is sent to the system controller 102. The system controller 102 calculates control target values for electric field application, and control target values for UV light irradiation, on the basis of the information obtained from the medium type determination unit 108 and the ink volume judgment unit 110, and the image data for printing, and it controls the electric field controller 120 and the light source controller 122 in accordance with the calculation results.

The motor driver 116 is a driver (drive circuit) which drives the motor 138 in accordance with instructions from the system controller 102. The heater driver 118 is a driver for driving the heater 139 of the heating drum 34, and other sections, in accordance with instructions from the system controller 102.

The electric field controller 120 controls the voltage generated by the DC high voltage generator 78, in accordance with instructions from the system controller 102, and also outputs control signals to switch on and off the switches SWj1, SWj2 (j=1 to 4) shown in FIG. 7, thereby controlling the area in which an electric field is generated in the electrode unit 28.

The light source controller 122 comprises a light source control circuit for controlling the on/off operation, the lighting position, and the amount of light generated in the UV light source 16. The light source controller 122 controls light emission by the UV light source 16 in accordance with instructions from the system controller 102.

The print controller 130 has a signal processing function for performing various tasks, compensations, and other types of processing for generating print control signals (dot data) from the image data stored in the image memory 104 in accordance with commands from the system controller 102 so as to supply the generated dot data to the head driver 134. Prescribed signal processing is carried out in the print controller 130, and the ejection amount and the ejection timing of the ink droplets from the heads 50 of respective colors are controlled via the head driver 134, on the basis of the print data. By this means, prescribed dot size and dot positions can be achieved.

The print controller 130 is provided with the image buffer memory 132; and image data, parameters, and other data are temporarily stored in the image buffer memory 132 when image data is processed in the print controller 130. The aspect shown in FIG. 9 is one in which the image buffer memory 132 accompanies the print controller 130; however, the image memory 104 may also serve as the image buffer memory 132. Also possible is an aspect in which the print controller 130 and the system controller 102 are integrated to form a single processor.

The head driver 134 drives the actuators 58 which drive discharge in the respective heads 50, on the basis of the dot data supplied from the print controller 130. A feedback control system for maintaining constant drive conditions for the print heads may be included in the head driver 134.

The image data to be printed is externally inputted through the communications interface 100, and is stored in the image memory 104. At this stage, RGB image data is stored in the image memory 104, for example. The image data stored in the image memory 104 is sent to the print controller 130 through the system controller 102, and is converted into dot data for each ink color by a known dithering algorithm, random dithering algorithm or another technique in the print controller 130.

The print heads 50 are driven on the basis of the dot data thus generated by the print controller 130, so that ink is ejected from the print heads 50. By controlling ink ejection from the print head 50 in synchronization with the conveyance speed of the medium 20, an image is formed on the medium 20.

An electrorheological fluid (for example, dispersed fluid) subjected to an electric field from an external source, such as an electrode unit 28, has a property whereby it will not flow unless the externally applied stress $\tau$ exceeds a certain uniform value $\tau y$ (the yield stress). Furthermore, the value of this yield stress $\tau y$ depends on the properties of the electrorheological fluid and the intensity of the electric field applied to the electrorheological fluid. In other words, by setting the yield stress $\tau y$ to an appropriate value, it is possible to halt the flow of the ink droplets after their deposition on the medium 20, and hence beneficial effects can be obtained in terms of improving printing quality.

For example, in respect of ink bleeding and spreading, the yield stress $\tau y$ is set so as to satisfy the relationship:

(capillary force between ink and medium)<(yield stress $\tau y$ of ink). (Condition 1)

Furthermore, in respect of interference on the medium between ink droplets of the same color or different colors, and movement of the liquid, the yield stress $\tau y$ is set so as to satisfy the relationship:

(aggregation force between ink droplets)<(yield stress $\tau y$ of ink). (Condition 2)

Moreover, by setting the yield stress $\tau y$ in such a manner that it satisfies both (Condition 1) and (Condition 2) stated above, and then applying an electric field intensity corresponding to this yield stress value, it is possible to prevent ink bleeding and spreading at the same time as avoiding interference between ink droplets of the same color or different colors, and movement of the liquid, on the surface of the medium 20.

Figure 10:
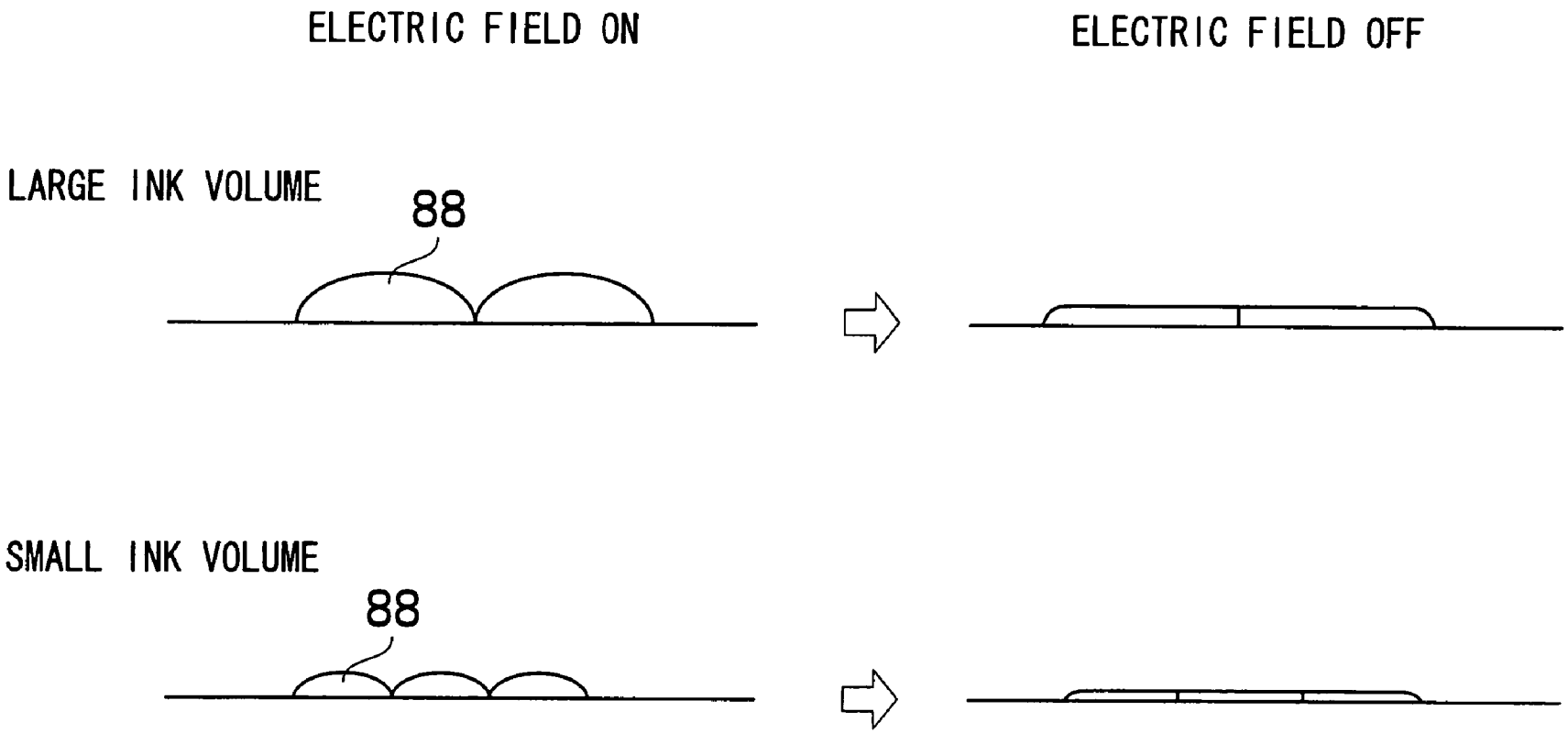
FIG. 10 is a diagram showing the behavior of deposited ink.

Next, the operation of the inkjet recording apparatus 10 having the foregoing composition will be described. FIG. 10 is a diagram showing the behavior of deposited ink. As shown on the left-hand side of FIG. 10, when an electric field is applied to the deposited ink 88 (electric field ON), an electrorheological effect is produced, the viscosity of the liquid increases, and the liquid droplets are maintained in a substantially hemispherical shape. In this state, ink bleeding and spreading is suppressed, and interference between ink droplets of the same color or different colors which are mutually adjacent on the medium 20, and movement of the liquid and the like, is also restricted.

When the application of the electric field is subsequently ceased (electric field OFF), the fluidity of the liquid increases and the ink surface (print surface) is smoothed, as shown on the right-hand side of FIG. 10.

By irradiating light onto the ink in this state, from the UV light source 16 (see FIG. 1) forming a fixing promotion device, it is possible to cure and fix the ink in a state where the ink surface has been smoothed. The time required for smoothing depends on the ink quantity (ink volume), and the time required for smoothing tends to become longer, the greater the ink volume. Furthermore, the permeability of the ink (in other words, the capacity of the ink droplets to remain on the medium) also varies with the medium type. Consequently, in the inkjet recording apparatus 10 of the present embodiment, the relative relationship between the switch-off timing of the electric field and the UV light irradiation timing is controlled in accordance with the type of medium 20, the type of ink, and the volume of ink ejected, in such a manner that a suitable smoothed state is obtained.

As shown in FIG. 10, the present invention provides technology which is particularly valuable for curing and fixing ink while the ink remains on the surface of the medium, when using a non-permeable medium or a medium of low permeability.

Figure 11:
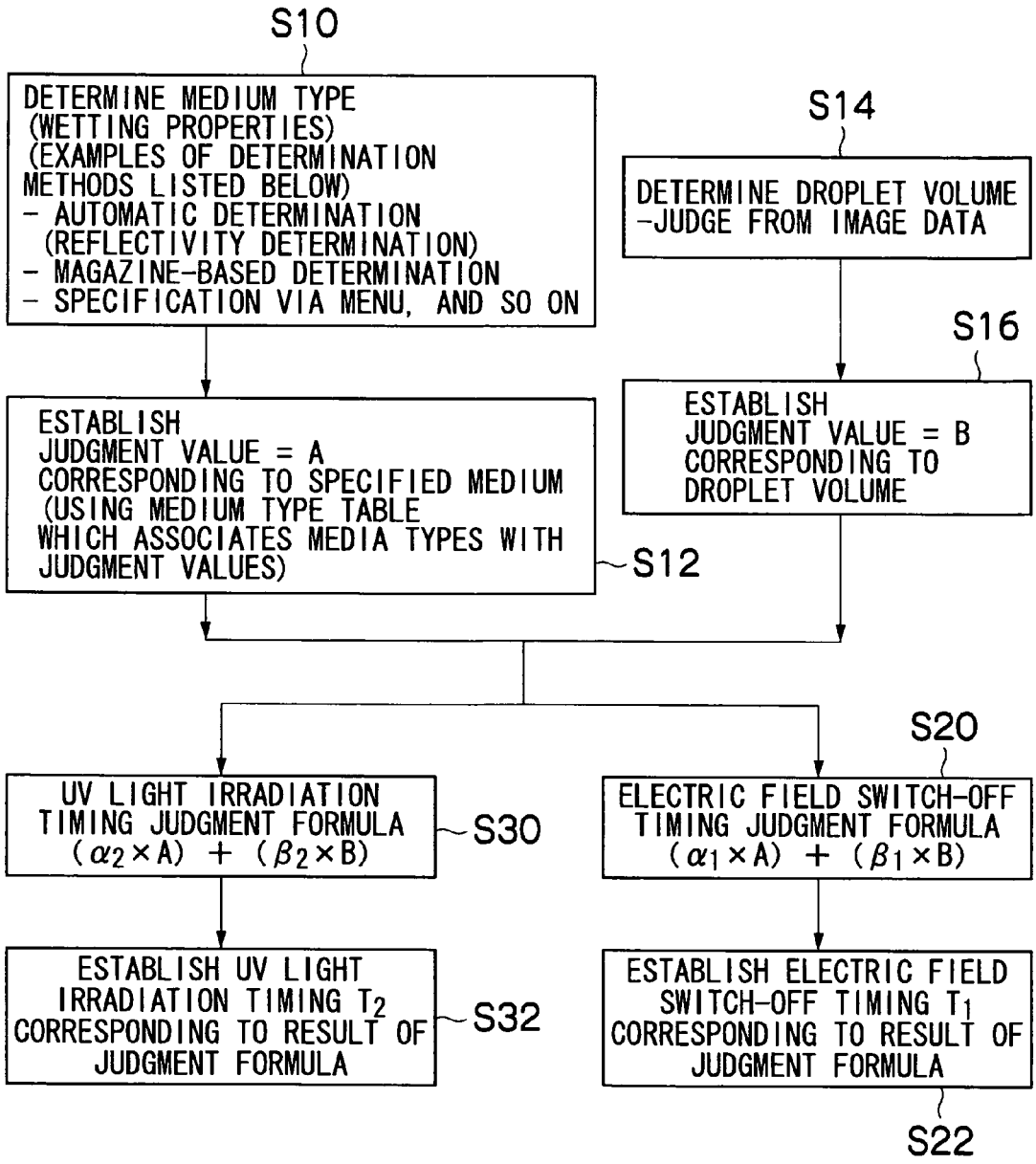
FIG. 11 is a flowchart showing an example of a control algorithm for the electric field switch-off timing and the UV light irradiation timing.

FIG. 11 is a flowchart showing a control procedure for the electric field switch-off timing and the UV light irradiation timing in the inkjet recording apparatus 10 relating to the present embodiment.

As shown in this diagram, firstly, a medium type judgment process is implemented (step S10). This judgment may be based, for example, on automatic determination by measuring the optical reflectivity of the medium 20, or on determination of the paper magazine, or specification of a paper type via a user interface menu, or the like.

On the basis of the medium type judgment result in step S10, the judgment value corresponding to the type of medium 20 used is established to be A (step S12). The inkjet recording apparatus 10 comprises an information storage device (internal memory or external memory) which stores data for a media type table that associates media types with judgment values. The judgment value is determined by referring to the media type table.

On the other hand, the volume of the liquid droplets ejected within the prescribed region on the medium 20 is also determined (step S14). In this process, the image data of the image to be printed is analyzed, and the volume of the ink droplets ejected within the prescribed image is determined. Here, the "prescribed image region" may be an area comprising a plurality of lines in the main scanning direction set within one particular image, or it may be the whole of an image.

On the basis of the result of the droplet volume judgment made in step S14, a judgment value corresponding to the droplet volume is established as B (step S16).

Subsequently, an electric field switch-off timing judgment formula $(\alpha_1 \times A)+(\beta_1 \times B)$ is calculated using the judgment values A and B, and the prescribed coefficients $\alpha_1$ and $\beta_1$ (step S20). On the basis of the result of the judgment formula at step S24, an electric field switch-off timing $T_1$ corresponding to the result of the judgment formula is established (step S22). A table which associates calculation results for the judgment formula with electric field switch-off timings $T_1$ is stored in an information recording device of the apparatus (an internal memory or external memory), and an electric field switch-off timing $T_1$ is established by referring to the table.

Furthermore, the UV light irradiation timing judgment formula $(\alpha_2 \times A)+(\beta_2 \times B)$ is calculated using the judgment values A and B, and the coefficients $\alpha_2$ and $\beta_2$ determined at steps S12 and S16 (step S30). On the basis of the result of the judgment formula at step S30, a UV light irradiation timing $T_2$ corresponding to the result of the judgment formula is established (step S32). A table which associates calculation results for the judgment formula with UV light irradiation timings $T_2$ is stored in an information recording device of the apparatus (an internal memory or external memory), and a UV light irradiation timing $T_2$ is established by referring to the table.

The electric field switch-off timing $T_1$ and the UV light irradiation timing $T_2$ with respect to the deposited ink are controlled by adjusting the area in which an electric field is generated in the electrode unit 28, on the basis of the results obtained at steps S22 and S32.

Figure 12:
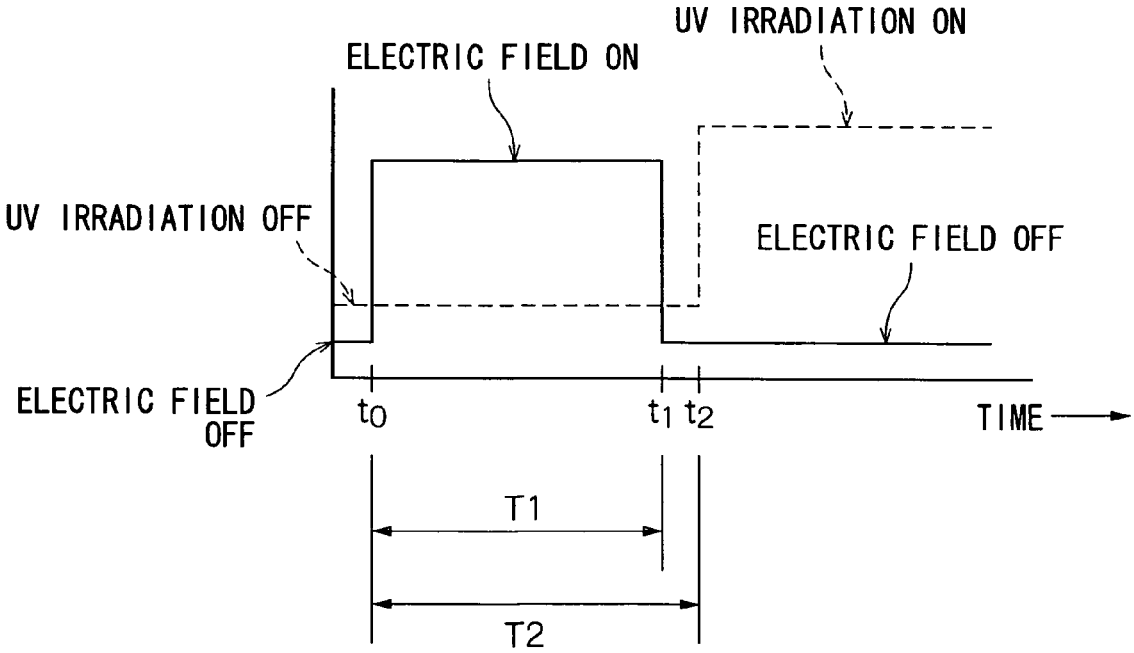
FIG. 12 is a timing diagram showing an example of the on/off timing of the electric field (solid lines) and the on/off timing of the UV light irradiation (broken lines), looking at a single deposited ink droplet.

FIG. 12 is a timing diagram showing an example of the on/off timing of the electric field (solid lines) and the on/off timing of the UV light irradiation (broken lines), looking at a single deposited ink droplet. In FIG. 12, timing $t_0$ indicates the timing at which an electric field is applied to the deposited ink droplet (electric field switch-on timing) and timing $t_1$ indicates the timing at which the electric field is turned off (electric field switch-off timing). Timing $t_2$ indicates the timing at which the UV light is irradiated onto the deposited ink droplet (UV light irradiation switch-on timing).

In other words, the electric field is switched off after a time of $T_1$ with respect to timing $t_0$, and UV light is irradiated after a time of $T_2$. By altering the area in which the electric field is generated by the electrode unit 28 shown in FIG. 1, the electric field switch-off timing (time $t_1$) in FIG. 12 is changed. Consequently, the relative relationship (time differential) between the electric field switch-off timing and the UV light irradiation switch-on timing changes.

Specific examples of the control method include those described below.

Control Method Example 1

If a medium having high porosity and rapid permeation is being used, or if the droplet ejection volume (droplet volume) is small, or if there is a combination of these circumstances, then the tendency of the control procedure is to delay the electric field switch-off timing (namely, to lengthen the period of $T_1$), and to advance the UV light irradiation timing (namely, to shorten the period of $T_2$).

Control Method Example 2

Conversely, if a medium having low porosity and slow permeation is being used, or if the droplet ejection volume (droplet volume) is large, or if there is a combination of these circumstances, then the tendency of the control procedure is to advance the electric field switch-off timing (namely, to shorten the period of $T_1$), and to delay the UV light irradiation timing (namely, to lengthen the period of $T_2$).

In FIG. 12, an example is illustrated in which UV light is irradiated after switching off the electric field ($T_1<T_2$), but in implementing the present invention, it is also possible to adopt a control mode in which the irradiation of UV light is started while the electric field is still on, and the electric field switches off while the UV light is being irradiated ($T_1>T_2$).

The embodiment described above related to a structural example in which an electrode unit 28 capable of controlling the area in which an electric field is generated is disposed on the inner side of a minimally conductive belt 43, but in implementing the present invention, the specific device for adjusting the electric field switch-off timing and the UV light irradiation timing is not limited to this embodiment.

For example, it is also possible to adopt a composition using an endless belt embedded with electrode pairs for generating electric field, instead of the conveyance unit 26 shown in FIG. 1 and FIG. 7 to FIG. 8. In this case, for example, the cross-sectional structure of the belt can be made similar to that shown in FIG. 8. Furthermore, in this case, the area in which the electric field is generated is adjusted by providing a mechanism which alters the region to which voltage is applied to the electrode pairs embedded in the belt (for example, a sliding contact structure which can change the range of electrodes connected to the DC high voltage generator 78), and thus controlling the region to which the voltage is applied.

Moreover, for the conveyance unit 26, it is also possible to use a structure which conveys a table that supports the medium (a table conveyance mechanism), instead of the belt conveyance mechanism.

The foregoing embodiment described a composition in which UV light irradiation position is fixed, while the area of electric field generation (in other words, the electric field switch-off position) can be controlled, but in implementing the present invention, a composition in which the area of electric field generation is fixed, while the UV light irradiation position is altered, may also be adopted, provided that the relative position between the electric field switch-off timing and the UV light irradiation timing can be controlled.

Further Embodiment

Figure 13:
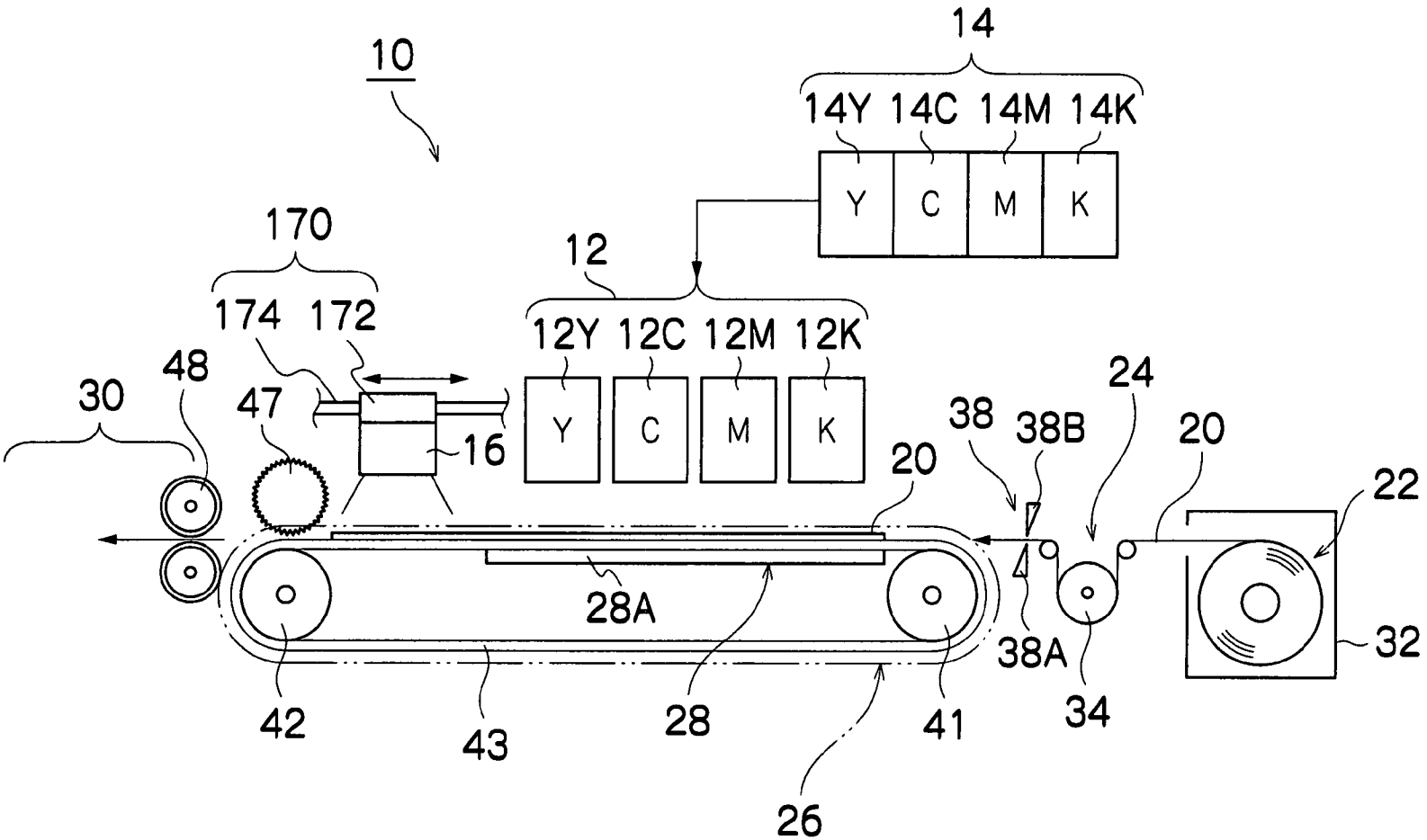
FIG. 13 is a general schematic drawing of an inkjet recording apparatus relating to a further embodiment of the present invention.
Figure 14:
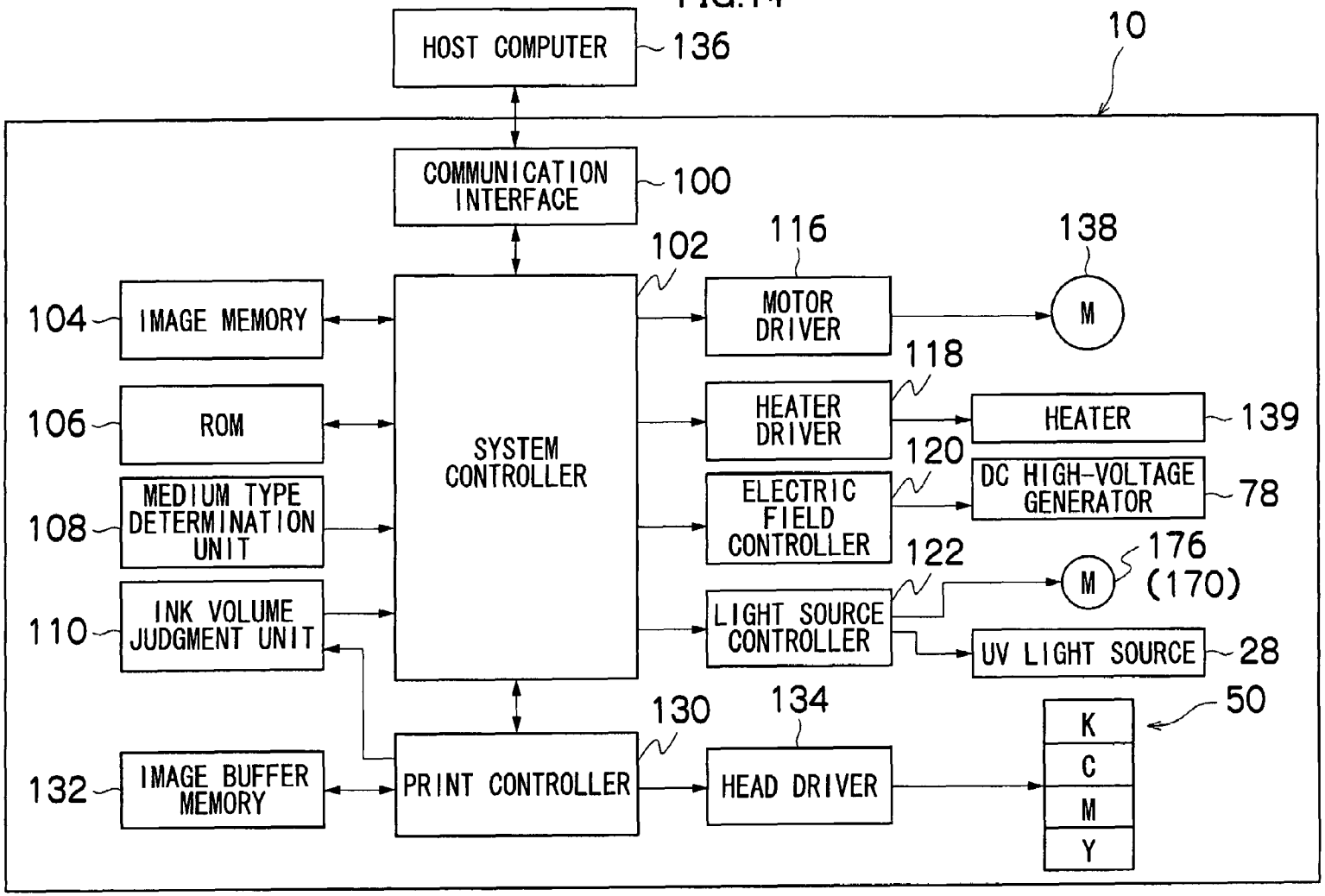
FIG. 14 is a principal block diagram showing the system configuration of the inkjet recording apparatus shown in FIG. 13.

FIG. 13 is a schematic drawing showing a further embodiment of the present invention, and FIG. 14 is a principal block diagram of same. In FIG. 13 and FIG. 14, items which are the same as or similar to those in FIG. 1 and FIG. 9 are labeled with the same reference numerals and description thereof is omitted here.

In the example in FIG. 13, the electrode unit 28 is constituted by a fixed zone (28A) only, and the area in which the electric field is generated does not change at all. On the other hand, the UV light source 16 is supported movably in the conveyance direction of the medium by means of a light source movement mechanism 170.

The device for moving the UV light source 16 is not limited in particular, but, for example, the light source movement mechanism 170 is constituted by a movable platform 172 to which the UV light source 16 is fixed, a guide member 174 for causing the movable platform 172 to travel in line with the medium conveyance direction, and a motor 176 (not shown in FIG. 13, but shown in FIG. 14) which drives the movable platform 172.

As shown in FIG. 14, the light source controller 122 includes a driver which drives the motor (for example, a stepping motor) 176 that supplies motive power to the light source movement mechanism 170, and it controls the position of the UV light source 16 (UV light irradiation position) on the basis of instructions from the system controller 102.

In FIG. 13, the UV light irradiation timing is advanced, the nearer the position of the UV light source 16 to the print unit 12, and conversely, the UV light irradiation timing is delayed, the further the position of the UV light source 16 from the print unit 12. By changing the position of the UV light source 16 in this way, it is possible to adjust the relative relationship between the electric field switch-off timing and the UV light irradiation timing. Following the flowchart described in FIG. 11, the electric field switch-off timing ($T_1$) and the UV light irradiation timing ($T_2$) are specified in accordance with the medium type, the ink type and the ink volume, and hence the position of the UV light source 16 is controlled on the basis of the specified timings. By causing the range of movement of the UV light source 16 to overlap partially with the range in which an electric field is generated by the electrode unit 28, it is possible to advance the UV irradiation timing to a time before the electric field switch-off timing.

Furthermore, a mode is also possible in which a composition for controlling the electric field generation area as shown in FIG. 1 and FIG. 7 to FIG. 9 is combined with a composition for controlling the UV light irradiation position as shown in FIG. 13 and FIG. 14. By controlling both the electric field generation area and the UV light irradiation position, it is possible to achieve more finely controlled conditions, and hence the electric field application conditions and the UV light irradiation conditions can be optimized.

The foregoing description related to examples where UV-curable ink is used, but in implementing the present invention, the ink is not limited to a light-curable ink, of which UV-curable ink is a typical example, and other radiation-curable inks which are cured by electron beams, X rays, or the like, may also be used. In this case, a fixing promotion processing unit using a radiation source suitable for activating the hardening agent (namely, activating polymerization) is provided, according to the type of ink used.

Furthermore, in the respective embodiments described above, an inkjet recording apparatus using a page-wide full line type head having a nozzle row of a length corresponding to the entire width of the medium (recording medium) has been described, but the scope of application of the present invention is not limited to this, and the present invention may also be applied to an inkjet recording apparatus using a shuttle head which performs image recording while moving a short recording head reciprocally.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an ejection head which ejects ink having electrorheological properties onto a recording medium;

an electric field application device which applies an electric field to a droplet of the ink deposited on the recording medium;

a fixing promotion device which performs fixing promotion process for promoting fixing of the ink on the recording medium;

a timing control device which controls a time difference between an electric field application cessation timing at which an application of the electric field to the ink on the recording medium by the electric field application device is ceased and a fixing promotion process timing at which the fixing promotion process is performed by the fixing promotion device;

a conveyance device which causes the ejection head and the recording medium to move relatively to each other by conveying at least one of the ejection head and the recording medium in a relative movement direction; wherein:

the electric field application device has a structure which is divided into a plurality of electrode regions aligned in the relative movement direction, electrode pairs each including a first electrode and a second electrode being disposed respectively in the electrode regions;

the timing control device changes the region in which the electric field is generated by controlling application and non-application of voltage to the electrode pairs of the respective electrode regions;

the electric field application device has an electrode region corresponding to a printing region of an ejection head and a plurality of electrode regions disposed in a range from a trailing end of the printing region until a process region of the fixing promotion device; and an electric field generation area is changed in terms of a conveyance direction of the recording medium by selectively applying voltage to the plurality of electrode regions according to at least one of a type of the recording medium, a type of the ink, and an ejection volume of the ink.

* * * * *